US005527043A

United States Patent [19]

Shimosaka

[11] Patent Number: 5,527,043

[45] Date of Patent: Jun. 18, 1996

[54] GOLF BALL

[75] Inventor: Hirotaka Shimosaka, Yokohama, Japan

[73] Assignee: Bridgestone Sports Co., Ltd., Tokyo, Japan

[21] Appl. No.: 358,513

[22] Filed: Dec. 19, 1994

[30] Foreign Application Priority Data

Dec. 21, 1993 [JP] Japan ..... 5-345215

[51] Int. Cl.[6] ..... A63B 37/12

[52] U.S. Cl. ..... 473/384; 473/383

[58] Field of Search ..... 273/232, 62, 220

[56] References Cited

U.S. PATENT DOCUMENTS

| | | | |
|---|---|---|---|
| 4,346,898 | 8/1982 | Badke | 273/232 |
| 4,991,852 | 2/1991 | Pattison | 273/232 |
| 5,009,428 | 4/1991 | Yamagishi et al. | 273/232 |

*Primary Examiner*—George J. Marlo
*Attorney, Agent, or Firm*—Sughrue, Mion, Zinn, Macpeak & Seas

[57] ABSTRACT

In the golf ball having a large number of dimples on its surface, a golf ball characterized in that dimples are arranged so as to satisfy the following condition for the plane development obtained by drawing imaginarily a great circle line to bisect the golf ball on the golf ball surface and developing the semisphere by the Lambert's equivalent projection. The center of the plane development is assigned to 0, drawing two large and small regular triangles ΔABC and Δabc centered at this 0 such that each vertex is in the same direction from the said center 0, extending each side of said small regular triangle Δabc so that it intersects each side of the large regular triangle ΔABC, thereby forming one regular triangle coinciding with said small regular triangle Δabc, three trapezoids, and three parallelograms, and arranging respectively 6 dimples in said one small regular triangle, 9 dimples in said trapezoid, and 4 dimples in said parallelogram. Provided that in the case where any dimple is formed over any two of the small regular triangle, trapezoid, and parallelogram, counting is based on the assumption that the dimple is present in the region where the dimple area accounts for more than 80% of the total area of that dimple.

9 Claims, 5 Drawing Sheets

FIG.3 (1)
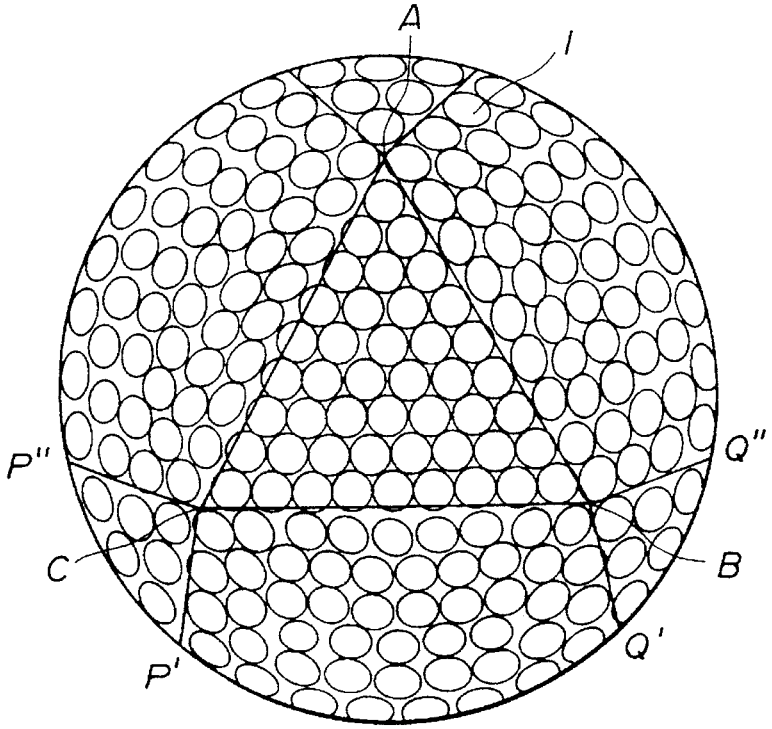
FIG.3 (2)
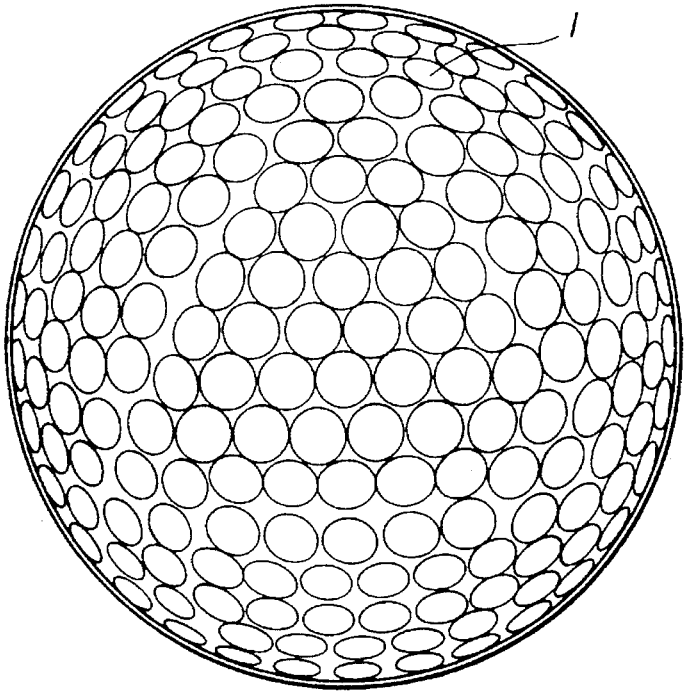

FIG.4 (1)
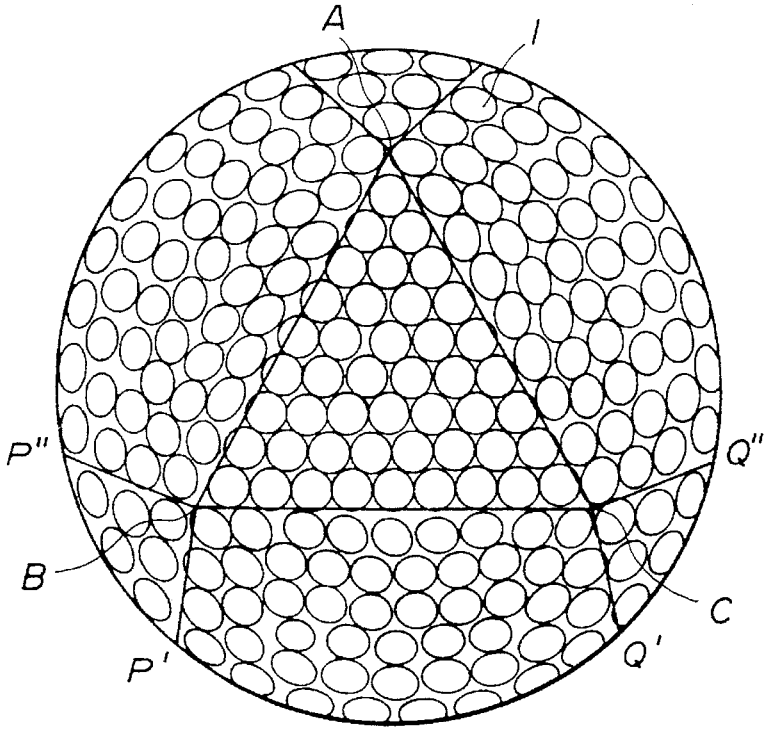
FIG.4 (2)
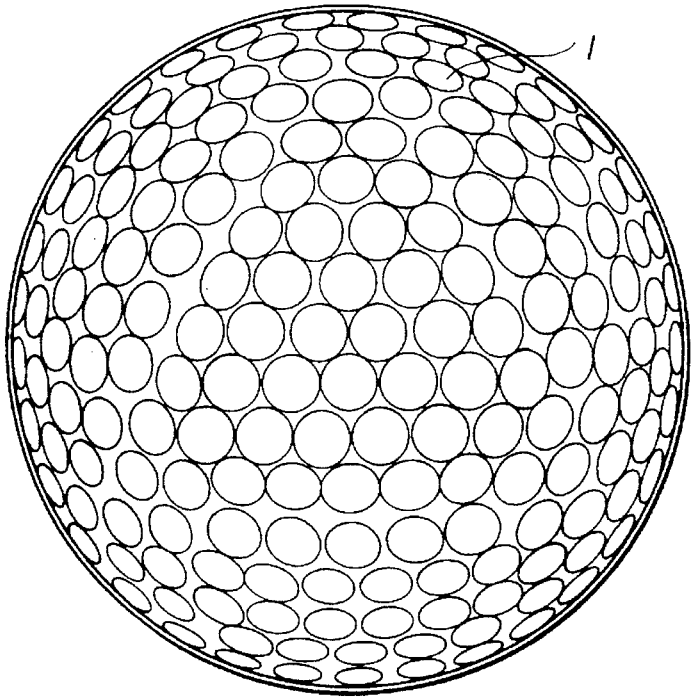

FIG.5 (1)
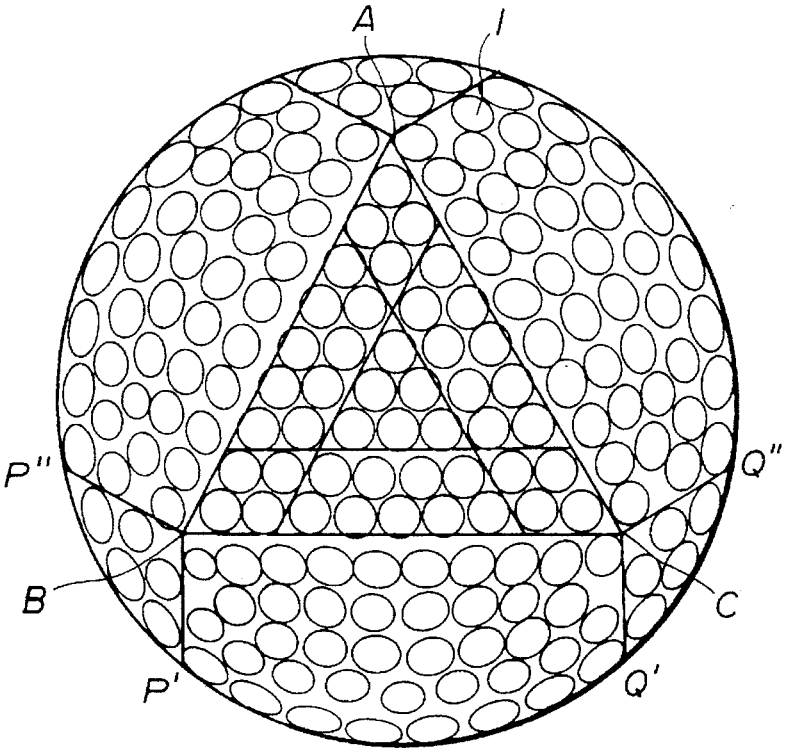
FIG.5 (2)
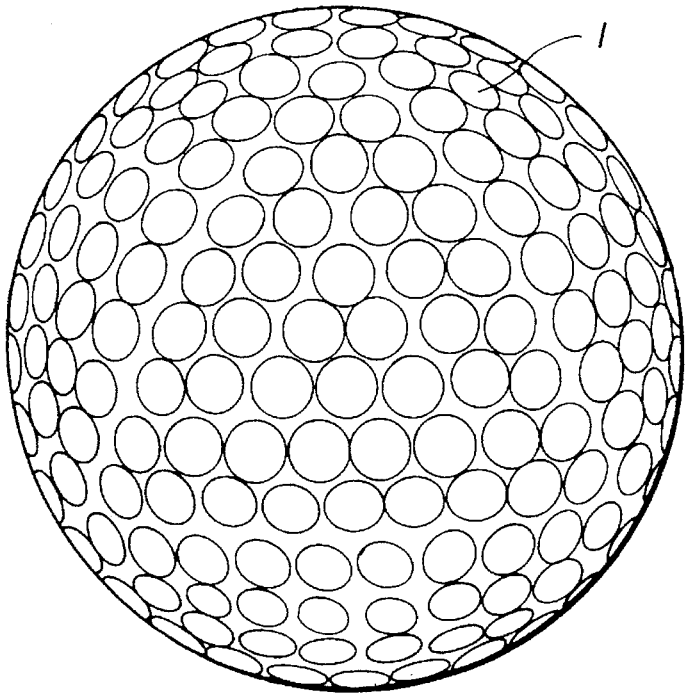

FIG.6 (1)
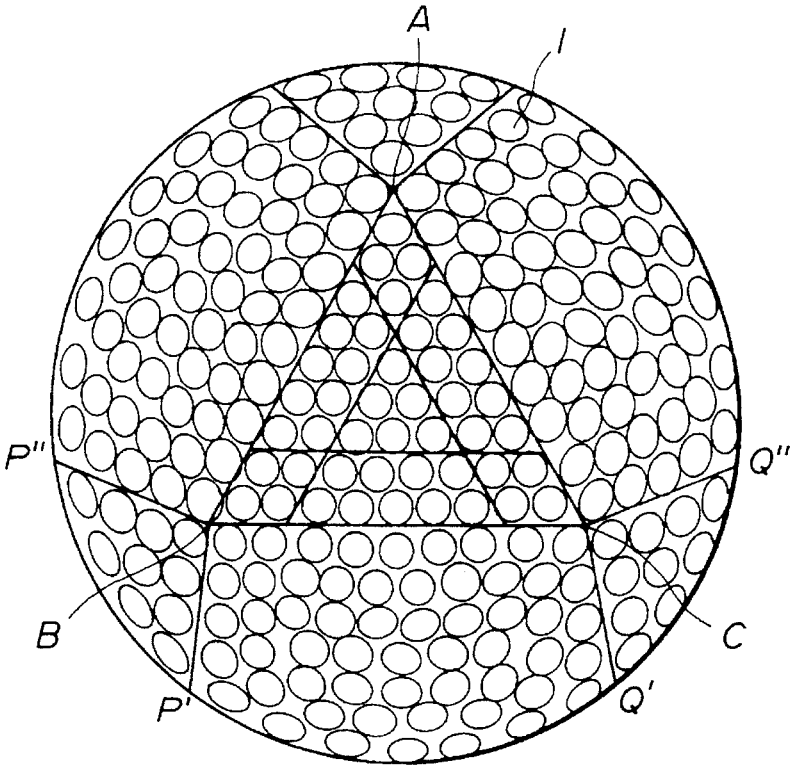
FIG.6 (2)
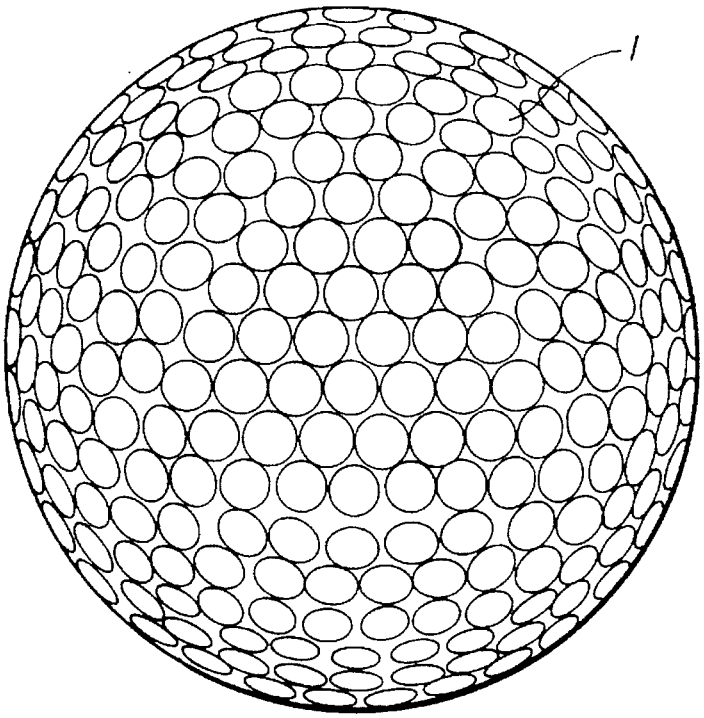

GOLF BALL

BACKGROUND OF THE INVENTION

1. Field of the Invention

The present invention relates to a golf ball in which dimples are densely arranged.

2. Description of the Prior Art

In a golf ball, the dimple arrangement greatly affects the fly performance of the golf ball, and therefore there have been proposed a variety of methods of arranging a large number of dimples uniformly or densely on the golf ball surface.

One dimple arranging method employs, the regular polyhedron arrangement and a method of dividing the semisphere into 1–7 equal parts from its center (pole) direction. Especially the method of dividing the ball into 3–6 equal parts is common.

In this case, among the regular polyhedron arrangement are the patterns which employ regular tetrahedron, regular octahedron, and regular icosahedron. Although there are the regular hexahedron and regular dodecahedron arrangements, they are homeomorph with the regular octagon and regular icosahedron, respectively. That is, nothing but those in which the vertex of the surface is replaced by the center. Also, the regular tetrahedron arrangement is not adopted generally. This regular polyhedron arrangement is one which designs one regular triangle and develops it overall. At this time, it is divided into smaller blocks depending on how the parting line is taken. Therefore, the regular polyhedron arrangement only needs the design of several small blocks and hence is simple but the degree of freedom is small and the dimple number etc. is limited.

On the other hand, in the method of dividing the semisphere into 1–7 equal parts from the pole direction, the degree of freedom is large but the design is complicated and it takes a large amount of labor to arrange dimples uniformly.

The present invention is intended to provide a golf ball in which dimples are arranged simply, uniformly, and densely in the case where dimples are arranged by equally dividing the semisphere from the pole direction.

SUMMARY OF THE INVENTION

In order to achieve the above-mentioned object, the present invention is a golf ball, in the golf ball having a large number of dimples on its surface, characterized in that dimples are arranged to satisfy the following condition [I] for the plane development obtained by drawing imaginarily a great circle line to bisect the golf ball on the golf ball surface and developing the semisphere by the Lambert's equivalent projection.

[I] Assigning the center of the plane development to 0, drawing two large and small regular triangles ΔABC and Δabc centered at this 0 such that each vertex is in the same direction from the center 0, extending each side of said small regular triangle Δabc so that it intersects each side of the large regular triangle ΔABC, thereby forming one regular triangle coinciding with the small regular triangle Δabc, three trapezoids, and three parallelograms, and arranging respectively dimples in the one small regular triangle, 9 dimples in the trapezoid, and 4 dimples in said parallelogram. Provided that in the case where any dimple is formed over any two of the small regular triangle, trapezoid, and parallelogram, counting is based on the assumption that the dimple is present in the region where the dimple area accounts for more than 80%.

BRIEF DESCRIPTION OF THE DRAWINGS

FIG. 3 shows a golf ball concerned with Example 1 of the present invention. (1) is a plane development, and (2) is a front view.

FIG. 4 shows a golf ball concerned with Example 2 of the present invention. (1) is a plane development, and (2) is a front view.

FIG. 5 shows a golf ball concerned with Example 3 of the present invention. (1) is a plane development, and (2) is a front view.

FIG. 6 shows a golf ball concerned with Example 4 of the present invention. (1) is a plane development, and (2) is a front view.

DESCRIPTION OF THE PREFERRED EMBODIMENTS

The dimple arranging method of the present invention is one in which the arranging method of three division of the semisphere from its center (the above-mentioned 0, pole) is simplified, and by changing freely the size of the large and small regular triangles, it is possible to change dimple diameter variously and select it. And, the arrangement of dimples within the above-mentioned block (small regular triangle, trapezoid, parallelogram) is easy, and it is possible to arrange dimples uniformly.

That is, by properly establishing the size of the large and small regular triangles and properly designing the dimple arrangement in the remaining part, it is possible to obtain the dimple arrangement equally divided into several block on the spherical surface. Thus it is possible to arrange 300–500 round dimples easily.

EXAMPLES

The examples of the present invention will be explained with reference to the drawings.

Figure 1:
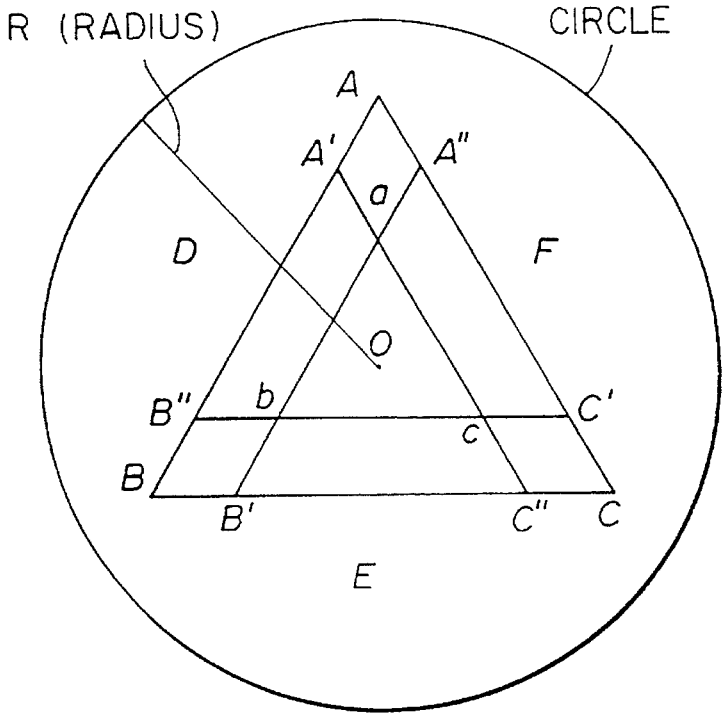
FIG. 1 is a plane development explaining the method of arranging dimples within ΔABC.

FIG. 1 explains the method of arranging dimples on the golf ball of the present invention. It illustrates a plane development obtained by drawing imaginarily a great circle line to bisect the golf ball on the golf ball surface and developing the semisphere by the Lambert's equivalent projection.

In the dimple arrangement of the present invention, the center of this plane development is assigned to 0, and two large and small regular triangles ΔABC and Δabc of proper size are drawn, with this 0 being the center. In this case, these two regular triangles ΔABC and Δabc are drawn such that their respective vertexes are present in the same direction from the above-mentioned center 0.

Here, it is desirable that assuming the radius of-the circle to be R, OA/R should be 0.60–0.82 (in the case where there are 170–250 dimples (3.3–3.9 mm in diameter) on the semisphere).

Then, each side ab, bc, ca of the above-mentioned regular small triangle Δabc is extended to each side BC, CA, ABC of the large regular triangle ΔABC, calling the point of intersection B', C', A', and extending up to each side CA, ABC, BC in the same manner, and calling the point of intersection A", B", C", thereby forming one regular triangle Δabc coinciding with the above-mentioned small regular triangle Δabc, three trapezoids aA'B"b, bB'C"c, cC'A"a, and three parallelograms (rhombuses) AA'aA", BB'bB", CC'cC", 7 blocks in total.

6 dimples are arranged within the above-mentioned regular triangle Δabc, 9 dimples are arranged within each of the trapezoids aA'B"b, bB'C"c, cC'A"a, and 4 dimples are arranged within each of the parallelograms AA'aA", BB'bB", CC'cC"; therefore, 45 dimples in total are arranged within the above-mentioned large and small regular triangles ΔABC and Δabc.

Here, in the case where any dimple is formed over any two of the above-mentioned small regular triangle, trapezoid, and parallelogram, counting is based on the assumption that the dimple is present in the region (block) where the dimple area accounts for more than 80%.

Then, dimples are properly arranged within the remaining parts, D, E, F in the above-mentioned plane development.

By projecting this onto the spherical surface (inverse mapping used to make a development), it is possible to obtain the dense dimple arrangement of about 300–500 having the dividing line.

Incidentally, it is desirable that dimples do not substantially intersect the boundary of each block when dimples are arranged within the above-mentioned block; however, it is permissible to arrange such that less than 20%, preferably less than 10%, enters other blocks. Also, dimples are usually of plane round shape; but this is not limiting.

Figure 2:
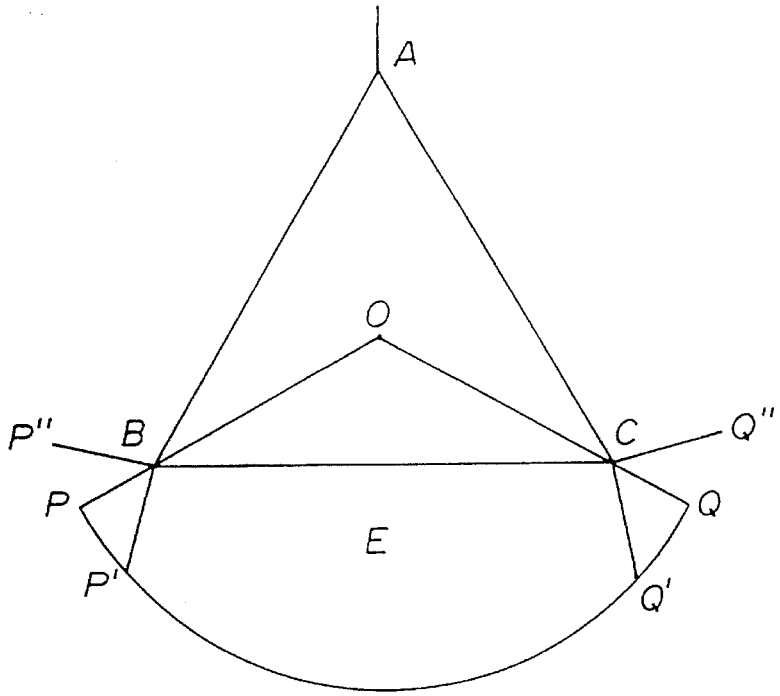
FIG. 2 is a plane development explaining the preferred method of arranging dimples within ΔABC.

In this case, it is desirable that the dimple arrangement in the region outside ΔABC (that is, the region D, E, F in FIG. 1) should be as shown in FIG. 2.

That is, the dimple arrangement in the region E is explained. In FIG. 2, if each of OB and OC is extended and the point of its intersection with the circumference is called P, Q respectively, the region E is the region surrounded by BPQC. From B, C toward the periphery, P', P". Q', Q" are taken such that <PBP'=<PBP"=<QCQ'=<QCQ" and <P'BP" and <Q'CQ" are in the range of 60°–120°. And, dimples are arranged such that they do not intersect the segment BP', BP", CQ', CQ". In this way, 3 lines are formed when the golf ball is molded, taking P"BCQ" as example except the seam line on the semisphere. Therefore, the nonuniformity of dimple arrangement due to not causing dimples to intersect the seam line is rectified, and a well-balanced dimple arrangement can be obtained.

Then, since the number of dimples in contact with side BC in ΔABC is 9, 9–11 dimples (especially 10 dimples) are arranged at the part in contact with side BC within the region E (provided that the dimples on BP and CQ are counted as ½ respectively). Subsequently, dimples are arranged toward the arc PQ, while maintaining the interval between dimples almost equal. After all, it is desirable that dimples should be arranged sequentially 1, 2, 3, . . . 9, 10 toward the arc PQ from the direction of A in the region ABPQCA. It is possible to obtain by this, the uniform, dense dimple arrangement (refer to FIGS. 3–6).

By the dimple arrangement method as mentioned above, it is possible to change the dimple diameter by properly changing the size of the large and small regular triangles ΔABC and Δabc, and in response to this, the dimple arrangement in the other parts, D, E, F can be performed easily, and the uniform, dense dimple arrangement is achieved.

FIG. 3 to FIG. 6 illustrate Examples of the golf ball in which dimples are arranged according to the above-mentioned arrangement method. Incidentally, in FIG. 3 to FIG. 6, (1) is a diagram in which dimples are arranged according to the above-mentioned arrangement method in the plane development, (2) is a plan view in the state of projection onto the spherical surface, and 1 shows a dimple. The value of OA/R, the dimple number, and the surface occupancy ratio in each Example are as shown below.

| Example 1: FIG. 3 | |
|---|---|
| OA/R | 0.68 |
| Dimple number | 210/semisphere |
| Dimple surface occupancy ratio | 70% |
| Dimple kind diameter | 1 diameter |
| **Example 2: FIG. 4** | |
| OA/R | 0.68 |
| Dimple number | 210/semisphere |
| Dimple surface occupancy ratio | 74% |
| Dimple kind | 3 diameters |
| **Example 3: FIG. 5** | |
| OA/R | 0.79 |
| Dimple number | 183/semisphere |
| Dimple surface occupancy ratio | 69% |
| Dimple kind | 2 diameters |
| **Example 4: FIG. 6** | |
| OA/R | 0.64 |
| Dimple number | 243/semisphere |
| Dimple surface occupancy ratio | 75% |
| Dimple kind | 2 diameter |

Each of the above-mentioned golf balls is one in which the parting line does not stand out and dimples are arranged uniformly. The result of hitting test of a each golf ball was good in fly performance and symmetry.

EFFECT OF THE INVENTION

The golf ball of the present invention has a great degree of freedom because dimples are arranged by dividing the semisphere equally from the pole direction, and since the dimples are formed simply, uniformly, and densely, it is superior in fly performance and symmetry.

What is claimed is:

1. In the golf ball having 300 to 500 dimples symmetrically arranged on its surface, wherein dimples are arranged for a plane development obtained by drawing imaginarily a great circle line to bisect the golf ball on the golf ball surface and developing a semisphere by the Lambert's equivalent projection, said dimples arranged by assigning the center of said plane development to 0, drawing two large and small regular triangles ΔABC and Δabc centered at 0 such that each vertex is in the same direction from the said center 0, extending each side of said small regular triangle Δabc so that it intersects each side of the large regular triangle ΔABC, thereby forming one regular triangle coinciding with said small regular triangle Δabc, three trapezoids, and three parallelograms, said triangle ΔABC defining a first region for dimples, and arranging respectively 6 dimples in said one small regular triangle, 9 dimples in said trapezoid, and 4 dimples in said parallelogram, and wherein for any dimple formed over any two of the small regular triangle, trapezoid, and parallelogram, counting is based on the assumption that a dimple is present in the region where its dimple area accounts for more than 80% of the total area of that dimple.

2. The golf ball of claim 1 wherein a relationship of OA/R is in the range of 0.60 to 0.82 where R is the radius of the golf ball and OA is a distance from said center 0 to a point A on said large regular triangle ΔABC.

3. The golf ball of claim 1 wherein said dimple arrangement is placed outside ΔABC by extending lines OB and OC to points of intersection with a circumference of said golf ball and defining a second region in which dimples are placed as in said first region.

4. The golf ball of claim 1 wherein said dimples are of the same diameter.

5. The golf ball of claim 1 wherein said dimples are in the range of 3.3 to 3.9 mm in diameter.

6. The golf ball of claim 1 wherein said dimples are of 2 different diameters.

7. The golf ball of claim 1 wherein said dimples are of 3 different diameters.

8. A method of making a golf ball having 300 to 500 dimples on its surface and arranged by the steps of:

drawing imaginarily a great circle line to bisect the golf ball on the golf ball surface;

developing a semisphere by the Lambert's equivalent projection;

assigning the center of said plane development to 0;

drawing two large and small regular triangles ΔABC and Δabc centered at 0 such that each vertex is in the same direction from the said center 0; said triangle ΔABC defining a first region for dimples extending each side of said small regular triangle Δabc so that it intersects each side of the large regular triangle ΔABC, thereby forming one regular triangle coinciding with said small regular triangle Δabc, three trapezoids, and three parallelograms; and arranging respectively 6 dimples in said one small regular triangle, 9 dimples in said trapezoid, and 4 dimples in said parallelogram wherein for any dimple formed over any two of the small regular triangle, trapezoid, and parallelogram, counting is based on the assumption that the dimple is present in the region wherein the dimple area accounts for more than 80% of the total area of that dimple.

9. The method of claim 8 further comprising defining a second region for dimples by the steps of extending lines OB and OC to points of intersection with a circumference of said golf ball and defining a second region in which dimples are placed as in said first region.

* * * * *